US009546459B2

(12) United States Patent
Allega

(10) Patent No.: US 9,546,459 B2
(45) Date of Patent: Jan. 17, 2017

(54) APPARATUS FOR REPOSITIONING TRAFFIC CONTROL DEVICES

(71) Applicant: James Allega, Brecksville, OH (US)

(72) Inventor: James Allega, Brecksville, OH (US)

( * ) Notice: Subject to any disclaimer, the term of this patent is extended or adjusted under 35 U.S.C. 154(b) by 46 days.

(21) Appl. No.: 14/518,030

(22) Filed: Oct. 20, 2014

(65) Prior Publication Data

US 2016/0108589 A1 Apr. 21, 2016

(51) Int. Cl.
*E01F 9/70* (2016.01)

(52) U.S. Cl.
CPC ..... *E01F 9/70* (2016.02)

(58) Field of Classification Search
CPC ..... E01F 9/014; E01F 9/70; E01F 9/654
USPC ..... 37/421
See application file for complete search history.

(56) References Cited

U.S. PATENT DOCUMENTS 3,034,237 A * 5/1962 Wolfe ..... E02F 3/769 37/241
5,328,066 A * 7/1994 Cappuccio ..... B60R 9/06 224/506
5,720,589 A * 2/1998 Christenson ..... B65F 3/00 414/408
5,885,046 A * 3/1999 Peek ..... E01F 15/006 404/73
6,056,498 A * 5/2000 Velinsky ..... E01F 9/014 414/501
6,158,948 A * 12/2000 Calvert ..... B60P 1/38 116/63 C
6,220,780 B1 * 4/2001 Schindler ..... E01F 9/014 404/6
7,431,532 B2 * 10/2008 Lidster ..... E01F 9/70 404/6
8,047,384 B2 * 11/2011 Mrowiec ..... E01F 9/014 211/44
D702,583 S * 4/2014 Laflamme ..... D10/121
2005/0196257 A1 * 9/2005 Villeneuve ..... E01F 9/014 414/434
2012/0207576 A1 * 8/2012 Kraft ..... B66F 9/144 414/785
2016/0222610 A1 * 8/2016 Stackpoole ..... E01F 9/70

* cited by examiner

*Primary Examiner* — Abigail A Risic
(74) *Attorney, Agent, or Firm* — Pearne & Gordon LLP

(57) ABSTRACT

An apparatus for repositioning traffic control devices includes a bracket configured for removable attachment to a vehicle. The apparatus further includes a striker arm attached to the bracket and projecting forward of the bracket at a first end of the striker arm so as to form an acute angle with respect to a direction of travel of the vehicle.

24 Claims, 6 Drawing Sheets

APPARATUS FOR REPOSITIONING TRAFFIC CONTROL DEVICES

BACKGROUND OF THE INVENTION

Field of the Invention

The present invention relates to the positioning of traffic control devices, such as barrel-type traffic control devices, cone-type traffic control devices, and the like. In particular, the present invention relates to devices, systems and methods for removing traffic control devices from a lane of traffic in a roadway.

Description of Related Art

It is known to employ temporary traffic control devices to modify or otherwise control the flow of vehicular traffic on roadways. For example, during roadway maintenance or construction operations, traffic control devices can be used to close lanes of traffic, shift traffic to other lanes, establish construction zones, etc. Example temporary traffic control devices include barrel-type devices, which are also known as drums, construction barrels or orange barrels. Example temporary traffic control devices also include cone-type devices, which are also known as traffic cones, construction cones, or bollards.

The deploying and removal of temporary traffic control devices is conventionally a manual process. The traffic control devices are typically set in place or removed by hand by a worker. The worker might follow a vehicle for storing the traffic control devices on foot, as he places the traffic control devices on the roadway or removes the traffic control devices from the roadway. The worker might also ride in the vehicle while deploying or removing the traffic control devices. In either case, deploying and removing the traffic control devices can require the labor of at least two people, one to handle the traffic control devices and another to drive the vehicle. The worker might also deploy or remove the traffic control devices without the assistance of a vehicle, such as by manually moving the traffic control devices from a lane of travel to another portion of the roadway. Manually handling the traffic control devices can be time consuming, especially over long stretches of roadway. It would be desirable to provide an apparatus that allows a single worker to quickly reposition traffic control devices and that eliminates the need to manually handle the traffic control devices during repositioning.

BRIEF SUMMARY OF THE INVENTION

The following summary presents a simplified summary in order to provide a basic understanding of some aspects of the devices, systems and methods discussed herein. This summary is not an extensive overview of the devices, systems and methods discussed herein. It is not intended to identify critical elements or to delineate the scope of such devices, systems and methods. Its sole purpose is to present some concepts in a simplified form as a prelude to the more detailed description that is presented later.

In accordance with one aspect provided is an apparatus for repositioning traffic control devices. The apparatus includes a bracket configured for removable attachment to a vehicle. The apparatus further includes a striker arm attached to the bracket and projecting forward of the bracket at a first end of the striker arm so as to form an acute angle with respect to a direction of travel of the vehicle.

In accordance with another aspect, provided is a system for repositioning traffic control devices. The system comprises a vehicle and a snowplow blade attached to the vehicle. The system further comprises a striker arm removably attached to the snowplow blade and projecting forward of the vehicle at a first end of the striker arm so as to form acute angles with respect to both of a direction of travel of the vehicle and a plowing surface of the snowplow blade.

In accordance with another aspect, provided is a method for repositioning traffic control devices. The method includes the step of attaching a striker arm to a vehicle such that the striker arm projects forward of the vehicle and forms an acute angle with respect to a direction of travel of the vehicle. The method further includes driving the vehicle in the direction of travel substantially parallel to an array of the traffic control devices, and striking the traffic control devices in sequence with the striker arm and sequentially repositioning the traffic control devices from a first lateral side with respect to the direction of travel to a second lateral side with respect to the direction of travel and opposite the first lateral side, by pushing the traffic control devices from the first lateral side to the second lateral side using the striker arm.

DETAILED DESCRIPTION OF THE INVENTION

Figure 1:
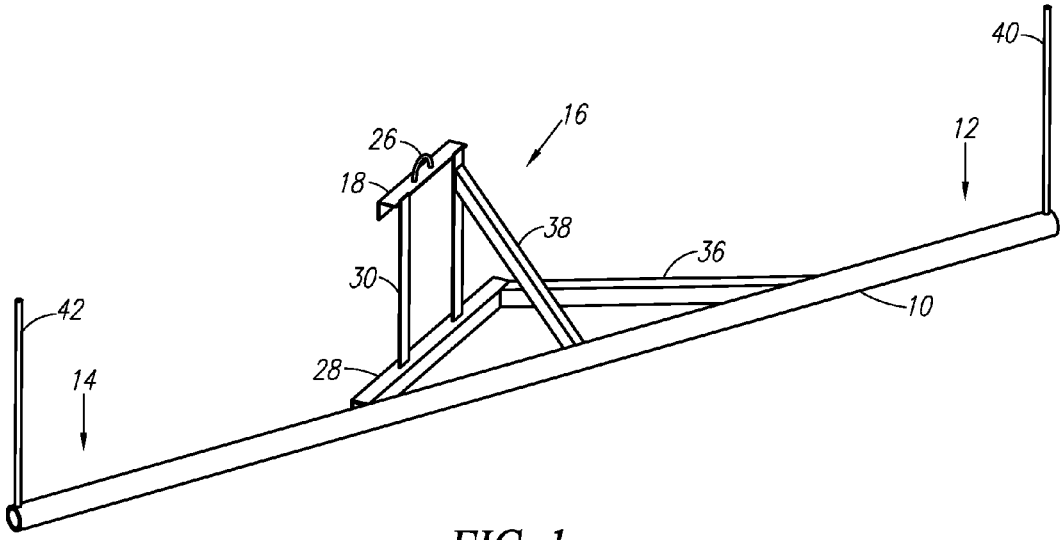
FIG. 1 is a perspective view of an apparatus for repositioning traffic control devices.

The present invention relates to devices, systems and methods for repositioning traffic control devices. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

FIG. 1 shows one example of a device that can be used for repositioning temporary traffic control devices, such as barrel-type traffic control devices and cone-type traffic control devices. As used herein, the term "cone-type" traffic control device includes bollards, which may have only a slight upward taper or no taper at all.

The device includes a striker arm 10 that is mounted to the front portion of a vehicle. The striker arm 10 is mounted at an acute angle with respect to the vehicle's direction of travel and is used to push temporary traffic control devices in order to reposition them. An operator of the vehicle drives toward a traffic control device and strikes it with a forward end portion 12 of the striker arm. As the vehicle continues moving forward, the traffic control device slides laterally along the striker arm toward a trailing or rearward end portion 14 of the striker arm. While sliding laterally, the traffic control device may or may not be pushed forward, in the direction of travel of the vehicle. Thus, the traffic control device moves substantially perpendicular to the vehicle's direction of travel and is pushed by the striker arm 10 from one lateral side of the vehicle and its direction of travel to the opposite lateral side.

The striker arm 10 can be used to reposition a plurality of temporary traffic control devices that are set out in an array for temporarily reconfiguring a traffic pattern, closing a lane in a roadway, establishing a construction zone, etc. Moreover, the striker arm 10 can allow an individual operator, i.e., the driver of the vehicle to which the striker arm is attached, to quickly reposition many temporary traffic control devices by simply driving through the array of traffic control devices at a suitable speed so that the traffic control devices are sequentially pushed out of the roadway lane (such as onto a shoulder portion of the roadway) by the striker arm 10.

When mounted to the vehicle, the striker arm 10 forms an acute angle with respect to the vehicle's direction of travel and also forms an acute angle with respect to the front of the vehicle, which is perpendicular to the vehicle's direction of travel. The forward end portion 12 of the striker arm 10 projects forward of the vehicle to form the acute angle with respect to the direction of travel. The acute angle of the striker arm 10 with respect to the direction of travel can be between 30° and 60°, such as approximately 45° for example.

Figure 2:
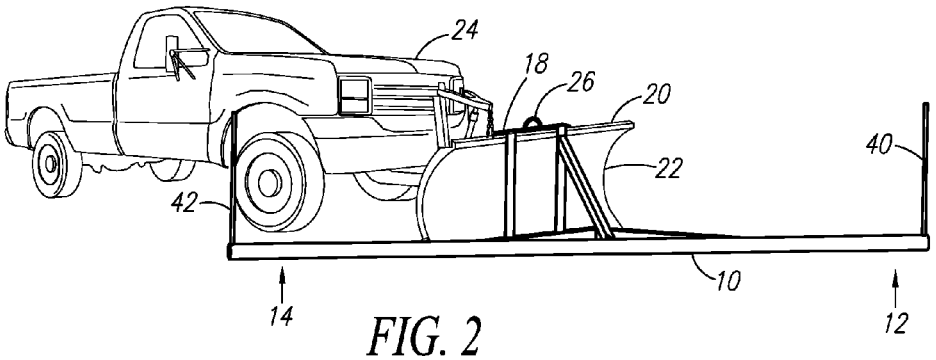
FIG. 2 is a perspective view of a system for repositioning traffic control devices.
Figure 3:
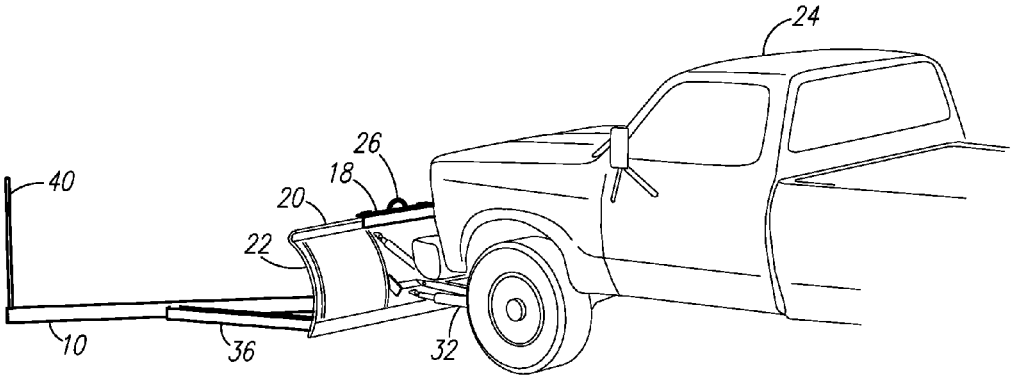
FIG. 3 is a perspective view of a system for repositioning traffic control devices.

The striker arm 10 can be mounted to the vehicle in any number of ways; however, it can be desirable to configure the striker arm to be readily removable from the vehicle. As shown in FIG. 1, the striker arm 10 can be attached to a bracket 16 for removably mounting the striker arm to the vehicle. The bracket 16 is essentially a frame for mounting the striker arm 10 to the vehicle and correctly positioning the striker arm with respect to the vehicle. In an embodiment, the bracket 16 includes an upper hanger 18 that is configured for hanging the striker arm from an edge surface attached to the vehicle. In particular, the edge surface can be the upper edge surface 20 of a snowplow blade 22 that is attached to the vehicle 24, as shown in FIG. 2. Thus, the bracket 16 and striker arm 10 can be hung from the upper edge surface 20 of the snowplow blade 22, and the striker arm can be used to "plow" the traffic control devices out of a lane of traffic. A rear perspective view of the upper hanger 18 mounted to the snowplow blade 22 is provided in FIG. 3.

The upper hanger 18 can have a profile suitable for engaging the upper edge surface 20 of the snowplow blade 22. For example, the upper hanger 18 can be formed from angle steel and have a generally L-shaped profile. Alternatively, the upper hanger 18 can be cup shaped or have a C-shaped profile, or other appropriately-shaped profiles. The upper hanger 18 can include a handle 26 that allows the bracket 16 and striker arm 10 to be lifted onto the snowplow blade 22.

The bracket 16 can include a lower bearing member 28 that is generally parallel to the upper hanger 18, but longer than the upper hanger. The lower bearing 28 member is suspended from the upper hanger 18 by one or more ties 30. The ties 30 can be formed from steel bar or other suitable tension-resistant materials. The lower bearing member 28 can be formed from square or round steel tubing, or other materials as desired. The striker arm 10 can be formed from materials similar to the lower bearing member 28. Lightweight, corrosion-resistant materials, such as PVC, can be used for various portions of the striker arm 10 and bracket 16 if desired.

The lower bearing member 28 is part of the framework for holding the striker arm 10 in place. The lower bearing member 28 also limits the downward pivoting of the bracket 16 toward the snowplow blade 22. The upper hanger 18 can pivotally engage the upper edge surface 20 of the snowplow blade 22. The weight of the striker arm 10 and bracket 16 tends to pivot the bracket downward, toward the snowplow blade 22. The lower bearing member 28 limits the downward pivoting of the bracket 16 by contacting the snowplow blade 22.

The striker arm 10 is angled away from the bracket 16 so that the bracket and striker arm are nonparallel. The forward end portion 12 of the striker arm 10 projects forward of the bracket 16 and lower bearing member 28 to form the acute angle with respect to the lower bearing member and the plowing surface of the snowplow blade 22. The acute angle of the striker arm 10 with respect to the lower bearing member 28 can be between 20° and 50°, such as approximately 30° for example. The snowplow blade 22 itself can be angled with respect to the direction of travel of the vehicle, rather than be oriented perpendicular to the direction of travel. If the angle of the striker arm 10 with respect to the lower bearing member 28 is approximately 30°, for example, the snowplow blade 22 can be pivoted to achieve a desired acute angle between the striker arm and the direction of travel. For example, the snowplow blade 22 can be pivoted approximately 15° to set the angle between the striker arm 10 and the direction of travel at approximately 45°. Alternatively, the angle between the striker arm 10 and lower bearing member 28 can be chosen such that the snowplow blade 22 is oriented generally perpendicular to the direction of travel when the striker arm is in use. Such an angle can be approximately 45°, for example. The snowplow blade 22 can be pivoted to the correct angle manually, or the snowplow blade can be driven by one or more hydraulic cylinders 32.

Due to the angled relationship between the striker arm 10 and the bracket 16, the trailing or rearward end portion 14 of the striker arm projects rearward of the bracket. The trailing or rearward end portion 14 of the striker arm 10 can be positioned in front of the vehicle 24, or it may extend rearward of the front of the vehicle.

The bracket 16 can include forward-projecting braces 36, 38 that secure the striker arm 10 to the bracket 16. The braces 36, 38 maintain the correct angle between the striker arm 10 and the bracket 16. The braces 36, 38 can be connected between the striker arm 10 and the lower bearing member 28, upper hanger 18, or ties 30 if desired.

It can be seen in FIG. 1 that the forward end portion 12 of the striker arm 10 can be cantilevered from the bracket 16, and in particular from a forward-projecting brace 36 of the bracket. The trailing or rearward end portion 14 of the striker arm 10 can also be cantilevered from the bracket 16, and in particular from the lower bearing member 28 or another brace if desired.

To aid the driver of the vehicle 24 in locating the ends of the striker arm 10, guide markers or guide sticks 40, 42 can be attached to the forward and rearward end portions of the striker arm. Guide markers are commonly used on snowplow blades to identify the lateral edges of the blade.

Figure 4:
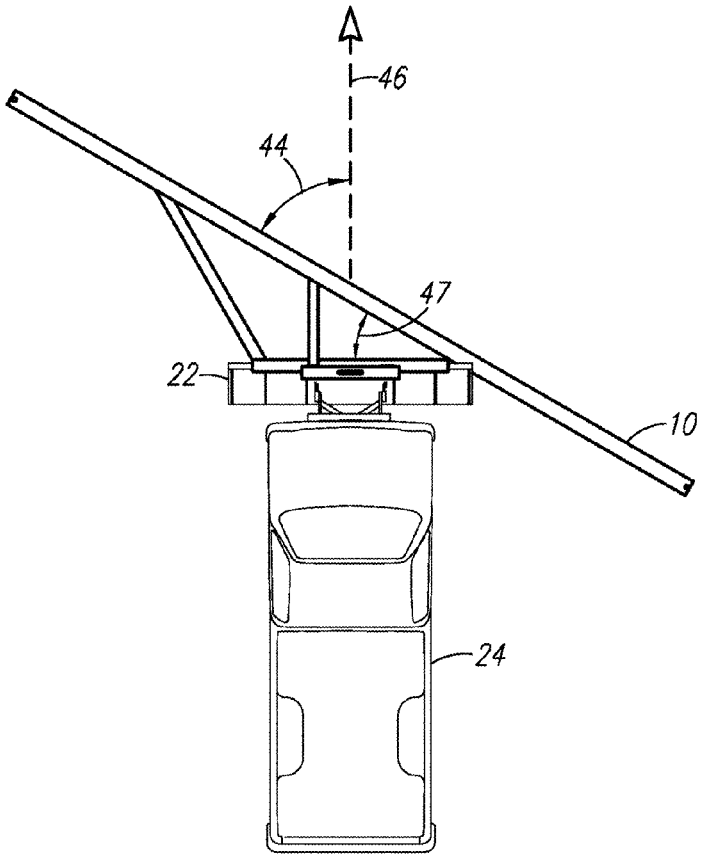
FIG. 4 is a plan view of a portion of a system for repositioning traffic control devices.
Figure 5:
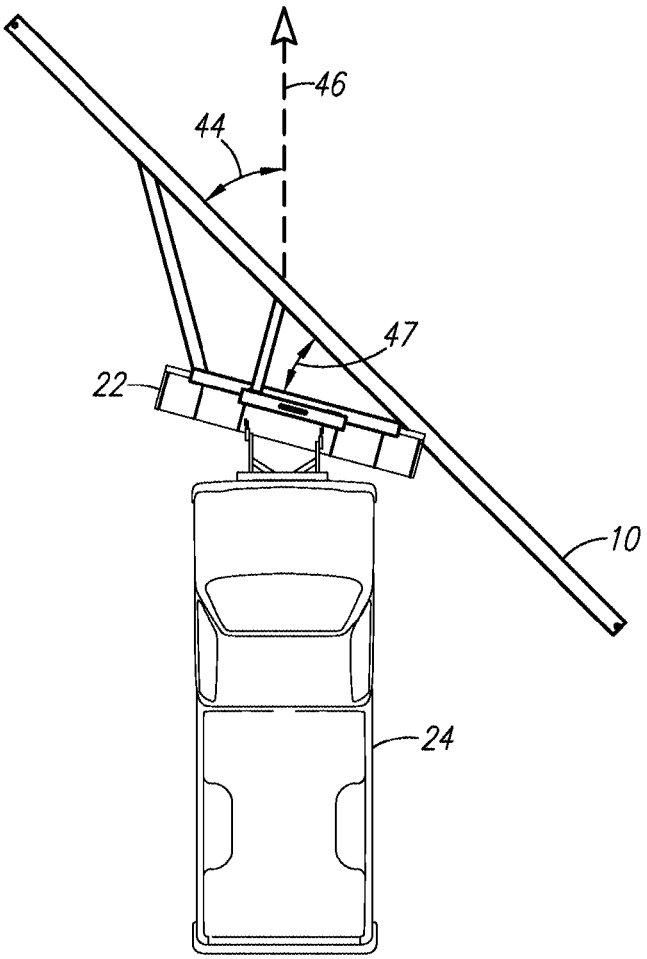
FIG. 5 is a plan view of a portion of a system for repositioning traffic control devices.

FIGS. 4 and 5 show an example of how the angle 44 of the striker arm 10 with respect to the direction of travel 46 can be changed by adjusting the angle of the snowplow blade 22 with respect to the direction of travel. In FIG. 4, the plowing surface of the snowplow blade 22 is generally perpendicular to the direction of travel 46, which makes the upper hanger and lower bearing member of the bracket 16 also generally perpendicular to the direction of travel. The striker arm 10 forms an acute angle 47 of about 30° with the bracket 16. Thus, the angle 44 of the striker arm 10 with respect to the direction of travel 46 is about 60° when the snowplow blade 22 is perpendicular to the direction of travel 46. Such an angle 44 may be too large to ensure that the traffic control devices move laterally, to the side of the lane of travel or onto a shoulder of the roadway. The angle 44 can be reduced by pivoting the snowplow blade 22 as shown in FIG. 5. In FIG. 5, the snowplow blade 22 is pivoted approximately 15° clockwise, thereby changing the angle 44 of the striker arm 10 with respect to the direction of travel from approximately 60° to approximately 45°. Adjustments of the snowplow blade 22 to angles greater or less than 15° are possible, and also in the counterclockwise direction, if desired.

In certain embodiments, the length of the striker arm 10 can be chosen so that it spans substantially the entire width of a lane of traffic when in use. For example, if the striker arm 10 is between 16 and 17 feet in length and oriented at approximately 45° with respect to the direction of travel, the striker arm will span substantially the entire width of a standard 12 foot wide lane of traffic. This can allow the striker arm 10 to sweep traffic control devices from a single lane of traffic without affecting the flow of traffic in an adjacent lane.

Figure 8:
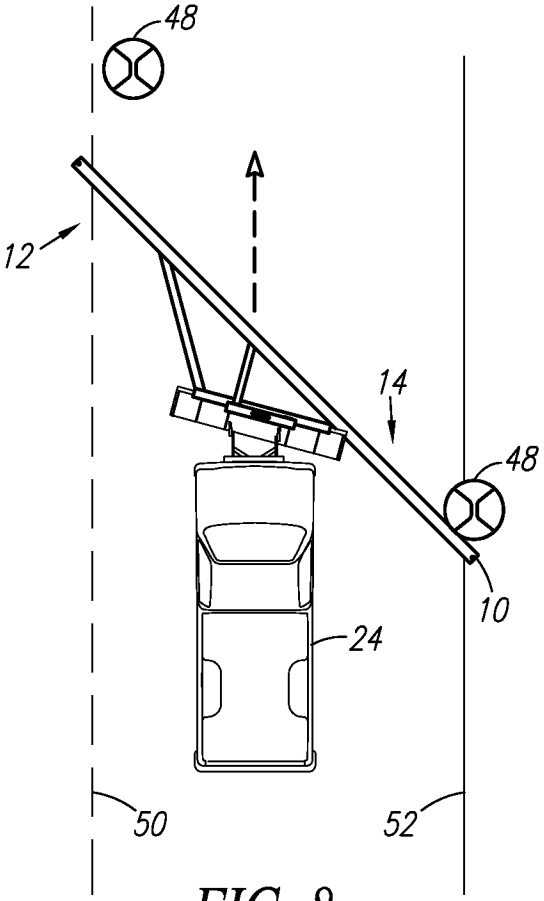
FIG. 8 schematically shows a system for repositioning traffic control devices in use.
Figure 7:
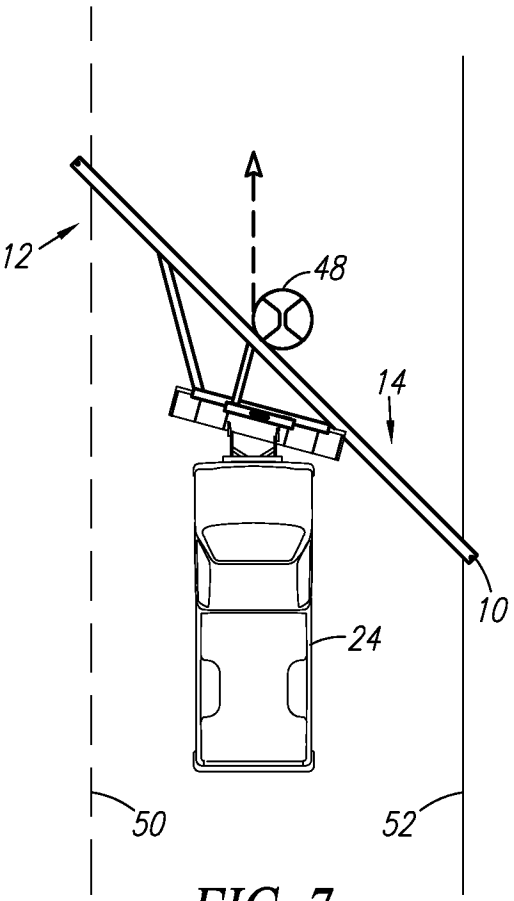
FIG. 7 schematically shows a system for repositioning traffic control devices in use.
Figure 6:
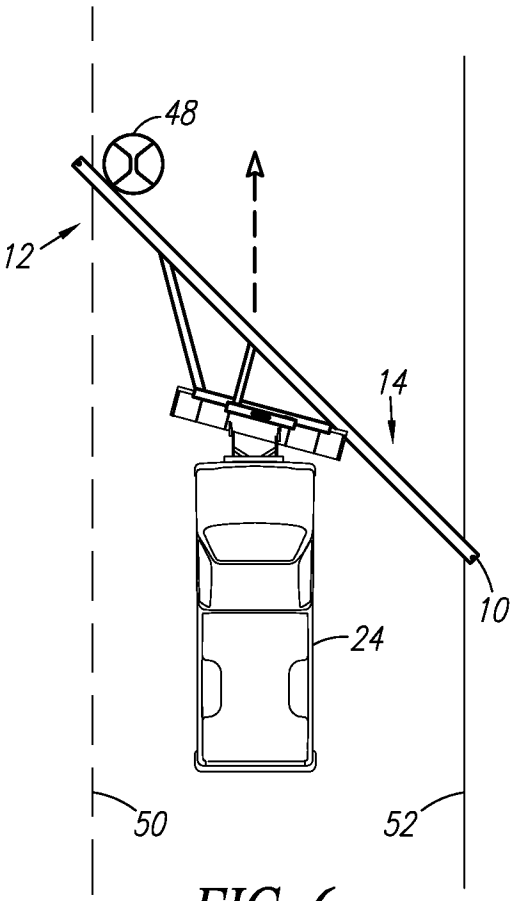
FIG. 6 schematically shows a system for repositioning traffic control devices in use.

FIGS. 6-8 schematically show the repositioning of temporary traffic control devices 48 using the striker arm 10. Lane 50 and shoulder 52 markings can be seen in the figures. The vehicle 24 is driven toward the traffic control device 48, and if the traffic control device is one of an array of traffic control devices arranged in the lane of travel, the vehicle can be driven substantially parallel to the array. As the vehicle 24 approaches the traffic control device 48, the striker arm 10 strikes the traffic control device along the forward end portion 12 of the striker arm. The vehicle 24 proceeds to drive the striker arm 10 against the traffic control device 48, causing the traffic control device to slide laterally from left to right, and possibly slide forward in the direction of travel. As the vehicle 24 continues moving forward, the traffic control device 48 slides along the striker arm 10 to the trailing or rearward end portion 14 of the striker arm and then into the shoulder portion of the roadway. In this way, each traffic control device 48 of an array of traffic control devices can be quickly and sequentially repositioned from one lateral side of the direction of travel to the opposite lateral side and, thus, removed from the lane of travel.

FIGS. 6-8 show the striker arm 10 being configured to push the traffic control devices 48 from the left or driver's side of the lane of travel to the right or passenger's side of the lane. It is to be appreciated that the striker arm 10 could be rotated to push the traffic control devices to the left, rather than to the right. Such a configuration can be useful when removing traffic control devices from a left-most passing lane, for example. In certain embodiments, the striker arm 10 can be selectively reconfigured to move traffic control devices in a left-to-right direction or in a right-to-left direction by relocating one or more of the forward-projecting braces from one side of the bracket to the other side.

The striker arm and bracket are shown in the drawings as being mounted to a snowplow blade. However, the striker arm or bracket could be mounted to various structural elements attached to the vehicle, such as a mount for supporting the snowplow blade, or the frame of the vehicle.

Figure 9:
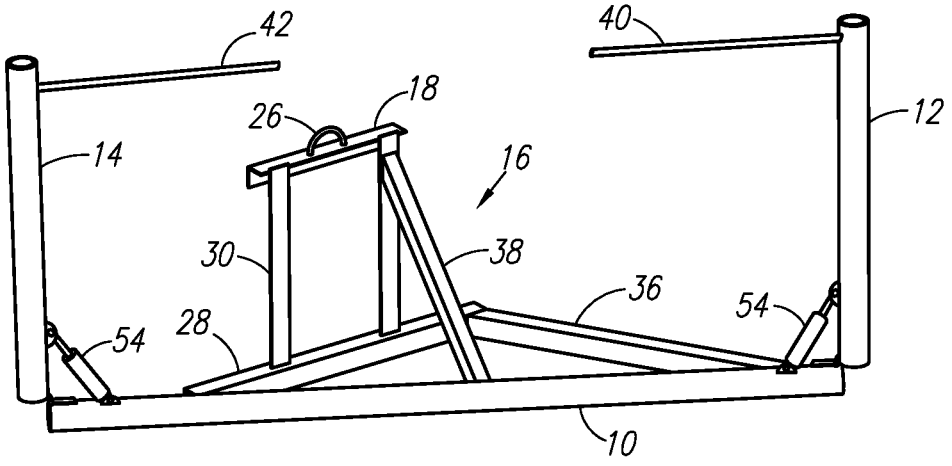
FIG. 9 is a perspective view of an apparatus for repositioning traffic control devices.

In the example embodiment shown in FIG. 9, the forward end portion 12 and the trailing or rearward end portion 14 of the striker arm 10 are retractable. Using an actuator, such as a hydraulic cylinder 54, the end portions 12, 14 of the striker arm 10 can be selectively moved between respective extended and retracted positions. In FIG. 9, the striker arm 10 is hinged so that the end portions 12, 14 pivot upward when retracted. Alternatively, the striker arm 10 could be telescopic so that the end portions 12, 14 retract axially into a central portion of the striker arm.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An apparatus for repositioning traffic control devices, comprising:

a bracket configured for removable attachment to a vehicle, wherein the bracket comprises an upper hanger configured for hanging the apparatus from an edge surface attached to the vehicle; and a striker arm attached to the bracket and projecting forward of the bracket at a first end of the striker arm so as to form an acute angle with respect to a direction of travel of the vehicle, wherein the first end of the striker arm and a second end of the striker arm are cantilevered from the bracket, wherein the second end of the striker arm projects rearward of the bracket.

2. The apparatus of claim 1, wherein the first end of the striker arm and the second end of the striker arm are selectively movable between respective extended and retracted positions.

3. The apparatus of claim 1, wherein the striker arm is angled away from the bracket such that the bracket and striker arm are nonparallel.

4. The apparatus of claim 1, wherein the bracket further comprises:

a first forward-projecting brace attached to the striker arm, wherein the first end of the striker arm is cantilevered from the first forward-projecting brace; and a second forward-projecting brace attached to the striker arm.

5. The apparatus of claim 1, wherein:

the bracket further comprises a lower bearing member attached to the upper hanger.

6. The apparatus of claim 1, further comprising a handle attached to the upper hanger.

7. The apparatus of claim 1, wherein the bracket comprises at least one forward-projecting brace extending between the bracket and the striker arm.

8. The apparatus of claim 5, wherein the first end of the striker arm projects forward of the bracket so as to form an acute angle with respect to the lower bearing member.

9. A system for repositioning traffic control devices, comprising:

a vehicle;

a snowplow blade attached to the vehicle;

a striker arm removably attached to the snowplow blade and projecting forward of the vehicle at a first end of the striker arm so as to form acute angles with respect to both of a direction of travel of the vehicle and a plowing surface of the snowplow blade; and a bracket attached to the striker arm and including an upper hanger configured for hanging the striker arm from an upper edge surface of the snowplow blade, wherein the first end of the striker arm and the second end of the striker arm are cantilevered from the bracket.

10. The system of claim 9, further comprising a hydraulic cylinder attached to the snowplow blade for simultaneously adjusting an angle of the snowplow blade with respect to the direction of travel and the acute angle of the striker arm with respect to the direction of travel.

11. The system of claim 9, wherein:

the upper hanger pivotally engages the upper edge surface of the snowplow blade, the bracket further comprises a lower bearing member attached to the upper hanger, and a downward pivoting of the bracket toward the snowplow blade is limited by the lower bearing member contacting the snowplow blade.

12. The system of claim 9, wherein the bracket further comprises at least one forward-projecting brace extending between the bracket and the striker arm.

13. The system of claim 9, wherein the second end of the striker arm projects rearward of the bracket.

14. The system of claim 13, wherein the first end of the striker arm and the second end of the striker arm are selectively movable between respective extended and retracted positions.

15. The system of claim 13, wherein the bracket further comprises:

a first forward-projecting brace attached to the striker arm, wherein the first end of the striker arm is cantilevered from the first forward-projecting brace; and a second forward-projecting brace attached to the striker arm.

16. A method for repositioning traffic control devices, comprising:

attaching a striker arm to a vehicle such that the striker arm projects forward of the vehicle and forms an acute angle with respect to a direction of travel of the vehicle, wherein the step of attaching the striker arm to the vehicle includes hanging the striker arm on a snowplow blade via a bracket attached to the striker arm, wherein a first end portion of the striker arm projects forward of the bracket and a second end portion of the striker arm projects rearward of the bracket, and the first end portion of the striker arm and the second end portion of the striker arm are cantilevered from the bracket;

driving the vehicle in the direction of travel substantially parallel to an array of the traffic control devices; and striking the traffic control devices in sequence with the striker arm and sequentially repositioning the traffic control devices from a first lateral side with respect to the direction of travel to a second lateral side with respect to the direction of travel and opposite the first lateral side, by pushing the traffic control devices from the first lateral side to the second lateral side using the striker arm.

17. The method of claim 16, wherein the step of striking the traffic control devices in sequence with the striker arm and sequentially repositioning the traffic control devices from the first lateral side with respect to the direction of travel to the second lateral side with respect to the direction of travel and opposite the first lateral side includes removing the traffic control devices from a lane of travel along a roadway.

18. The method of claim 17, wherein the step of removing the traffic control devices from the lane of travel along the roadway includes pushing the traffic control devices to a shoulder portion of the roadway adjacent the lane of travel using the striker arm.

19. The method of claim 17, wherein the traffic control devices include at least one of barrel-type traffic control devices and cone-type traffic control devices.

20. The method of claim 16, wherein the bracket comprises an upper hanger that pivotally engages an upper edge surface of the snowplow blade, and a lower bearing member that is attached to the upper hanger, wherein the lower bearing member limits a downward pivoting of the bracket toward the snowplow blade by contacting the snowplow blade.

21. The method of claim 16, wherein the striker arm is angled away from the bracket such that the bracket and striker arm are nonparallel.

22. The method of claim 16, wherein the bracket further comprises at least one forward-projecting brace extending between the bracket and the striker arm.

23. The method of claim 16, wherein the acute angle is between 30° and 60°.

24. The method of claim 16, further comprising the step of moving a first end portion of the striker arm and a second end portion of the striker arm from respective retracted positions to respective extended positions.

* * * * *